United States Patent [19]

Grossi

[11] Patent Number: 5,069,016

[45] Date of Patent: Dec. 3, 1991

[54] METHOD AND APPARATUS FOR CONTINUOUSLY PACKAGING BATCHES OF CONTAINERS OR THE LIKE

[76] Inventor: Renzo Grossi, via Jannozzi 16, 20097 S. Donato Milanese (Milan), Italy

[21] Appl. No.: 476,970

[22] Filed: Feb. 7, 1990

[30] Foreign Application Priority Data

Feb. 14, 1989 [IT] Italy ..... 19430 A/89

[51] Int. Cl.[5] ..... B65B 13/04; B65B 21/24; B65B 27/04

[52] U.S. Cl. ..... 53/398; 53/48.1; 53/399; 53/553; 53/586; 198/803.9

[58] Field of Search ..... 53/48, 49, 398, 534, 53/537, 553, 556, 48.5, 48.4, 48.7, 228, 399, 466, 586; 198/803.9

[56] References Cited

U.S. PATENT DOCUMENTS

| | | | |
|---|---|---|---|
| 3,541,751 | 11/1970 | Quebe et al. | 53/48 |
| 3,727,365 | 4/1973 | Stohlquist | 53/553 X |
| 3,729,894 | 5/1973 | Stohlquist | 53/553 X |
| 3,748,811 | 7/1973 | Cox | 53/553 X |
| 3,760,553 | 9/1973 | Schmidt, Sr. et al. | 53/537 X |
| 3,782,072 | 1/1974 | Sorensen et al. | 53/553 X |
| 3,927,507 | 12/1975 | Reid | 53/553 |
| 3,928,941 | 12/1975 | Singer | 53/553 |
| 3,940,305 | 2/1976 | Stenberg | 53/553 X |
| 4,369,613 | 1/1983 | Gess | 53/553 |
| 4,413,463 | 11/1983 | Lancaster | 53/556 X |

*Primary Examiner*—John Sipos
*Assistant Examiner*—Linda B. Johnson
*Attorney, Agent, or Firm*—Ladas & Parry

[57] ABSTRACT

The method comprises continuously wrapping ordered batches of containers (4) with either self adhesive or non-self adhesive films (A, B) of elastic plastics material (such as stretchable linear polyethylene). One of the films (A) forms the base of the wrapping and the other (B) the cover. The films (A, B) are welded together between one batch and the next (4) in a direction transverse to the direction in which the batches advance, and the batches are separated from each other by cutting the films. The apparatus comprises, for the spaced-apart batches of containers (4), a service conveyor (8) in contact with which the film (A) forming the base of the wrapping moves, and a plurality of mutually independent welding and cutting units (11) insertable individually into the gap between one batch and the next (4) to produce the weld and the cut, and extractable from said gap after welding and cutting. The apparatus also comprises transfer means (12, 13, 14) to transfer the welding and cutting units (11) from their point of extraction to their point of insertion. The service conveyor (8) conveys said units (11) from the insertion point to the extraction point.

31 Claims, 14 Drawing Sheets

METHOD AND APPARATUS FOR CONTINUOUSLY PACKAGING BATCHES OF CONTAINERS OR THE LIKE

BACKGROUND OF THE INVENTION

1. Field of the Invention

This invention relates to a method and apparatus for continuously packaging batches of containers or the like by means of plastics film. The invention also relates to the pack obtained.

2. Description of the Prior Art

It is known to combine a certain number of identical containers, such as six bottles or cans, into a single pack formed from films of heat-shrinkable plastics material. Packaging apparatus for this purpose comprise a heating path the purpose of which is to heat-shrink the films which wrap the containers. In addition, because of the impossibility of uniformly distributing the hot air (and thus the temperature) which comes into contact with the wrapping, it is not possible to use very thin heat-shrinkable films because of the formation of holes in the wrapping. However, by using stretchable material much thinner films can be used, with considerable economical advantage.

To avoid on the one hand the energy consumption deriving from the use of the heating path and on the other hand the cost of the (necessarily thicker) heat-shrinkable material, it would be theoretically possible to use in packaging apparatus employing the heat-shrinkable material the known self adhesive or non-self adhesive films of elastic plastics material (such as stretchable linear polyethylene). This is however impossible in practice because of the different elasticity characteristics of the two plastics materials. To reduce both the energy consumption and the cost per pack, it is therefore necessary to devise different packaging methods and machines to be able to work with elastic plastics materials.

SUMMARY OF THE INVENTION

An object of the present invention is therefore to provide a packaging method and apparatus based on the use of films of self adhesive or non-self adhesive elastic plastics material, having a productivity equal to or exceeding that obtained using heat-shrinkable materials, but without the relative thermal energy expense.

A further object of the present invention is to provide packaging for a batch of identical containers based on the use of self adhesive or non-self adhesive elastic plastics material which is robust and economical.

These and further objects which will be more apparent from the detailed description given hereinafter are attained by a method and apparatus in accordance with the accompanying claims.

BRIEF DESCRIPTION OF THE DRAWINGS

The invention will be more apparent from the detailed description of a preferred embodiment thereof given by way of non-limiting example hereinafter and illustrated on the accompanying drawing in which.

DETAILED DESCRIPTION OF THE PREFERRED EMBODIMENTS

Figure 1:
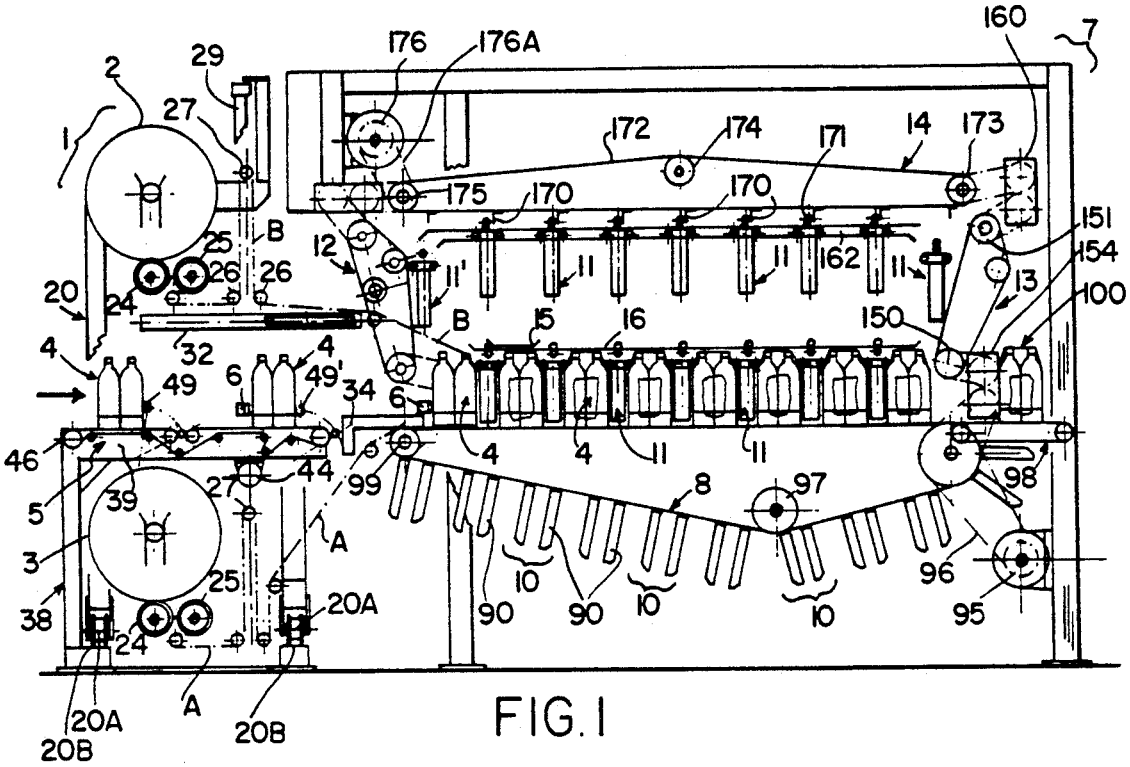
FIG. 1 is a schematic side elevational view of the invention overall.
Figure 1A:
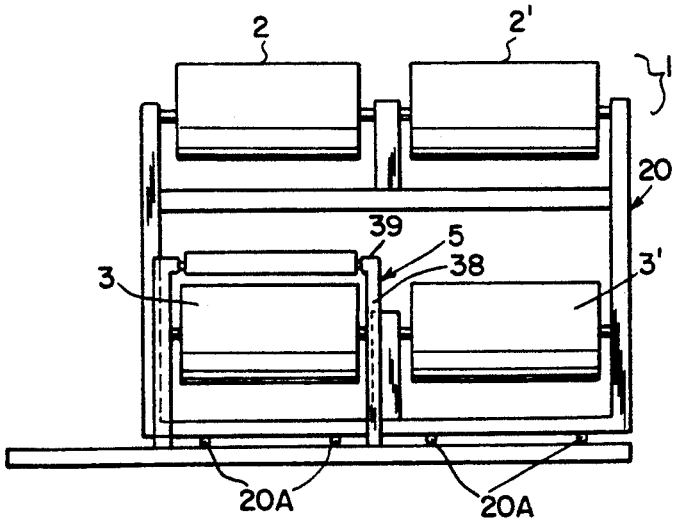
FIG. 1A is a still more schematic view thereof with parts omitted, taken in the direction of the arrow I of FIG. 1.

With reference to FIG. 1 showing the apparatus overall, and to FIG. 1A, the apparatus can be seen to comprise:

a) a feeder 1 supporting two pairs of reels 2, 2', 3, 3' (FIG. 1A). The reels 2' and 3' are stand-by whereas the two films A and B of elastic plastics material (such as stretchable linear polyethylene) are unwound from the reels 2 and 3 to wrap batches of containers 4, for example comprising six containers, to form the required pack which is shown schematically and indicated by 100;

b) a feed conveyor 5 for the batches of containers 4, which is associated with reciprocating pushers 6 for the purpose of transferring the batches 4 to the apparatus operational zone 7 in which the batches 4 are wrapped with the plastics films A, B and these latter are welded and cut;

c) the said operational zone 7, which is composed essentially of: a service conveyor 8 on which the batches of containers 4 rest via the base film A which unwinds from the lower reel 3; groups of four columns 10 connected to the service conveyor 8 for the purpose stated hereinafter; a plurality of mutually independent welding and cutting units 11, each to be inserted between and extracted from the columns of a group 10; a conveyor for recycling the welding and cutting units 11 and comprising three sections 12, 13 and 14, the first (12), called the lowering section, for inserting the units 11 into the groups of columns 10, the second (13), called the raising section, for extracting the units 11 from said groups 10, and the third (14), called the return section, for transferring the units 11 from the raising section 11 to the lowering section 12; and finally guides 15 and 16 which operate on the units 11 when these are inserted into the groups of columns 10, to respectively cut and weld the plastics films A and B wrapped about the batches of containers 4 and unwound from the reels 2 and 3. The guides 15, 16 can be lengthened and shortened telescopically.

Figure 2:
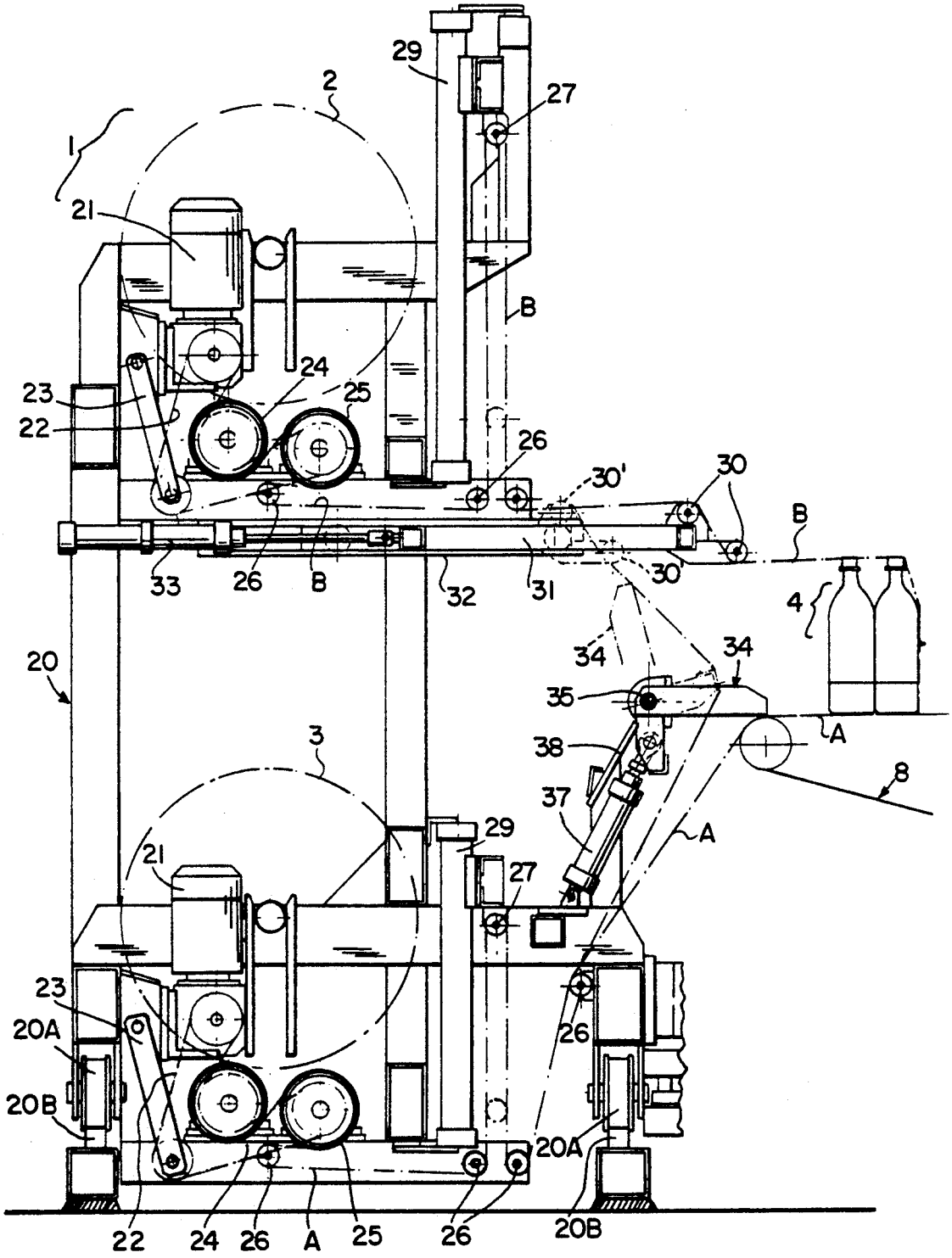
FIG. 2 is a more detailed view of the feeder for the elastic plastics films.

With reference to the further figures, which illustrate in greater detail said apparatus components and those to be still specified:

1) from FIG. 2 and with reference to FIGS. 1 and 1A it can be seen that the feeder 1 comprises a load-bearing structure 20 of metal sections, mounted on wheels 20A. These wheels are guided along fixed rails 20B which extend perpendicularly to the drawing plane of FIG. 2. The feeder is therefore in the form of a carriage which can be moved into two different end-of-travel positions by any known drive means such as a connecting rod-crank system driven by a geared motor, in order to move the stand-by reels 2', 3' into the working line when any one of the other pair (2, 3) is empty. As is apparent to the expert of the art, the command for this movement is given by sensors which sense when one or both reels are empty.

Figure 3:
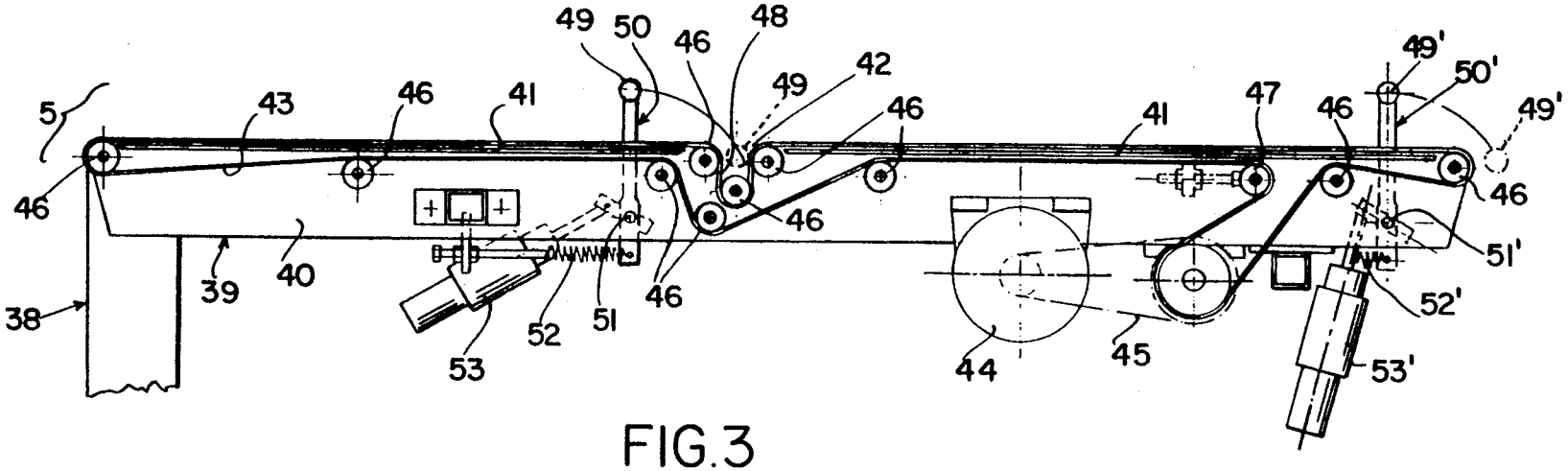
FIG. 3 is a schematic side elevational view of the feed table for the batches of containers.

For each reel the structure 20 comprises a geared motor 21 which by means of a toothed belt 22 and tensioning arm 23 drives two rubber-clad rollers 24, 25 about which the film (A, B) unwinding from the reel (2, 3) passes. By suitably choosing the pulleys which transmit movement to these rollers, to which they are connected, the roller 25 is made to rotate at a speed greater than that of the other roller so that the films (A, B) undergo preliminary stretching. By means of deviation rollers 26, the films are guided to and from an idle take-up roller 27 mounted on supports and vertically guided and shiftable by a conventional electropneumatic drive cylinder 29 of the rodless type. After leaving the last deviation roller 26 the film B passes over further deviation rollers 30 which are supported at the end of a carriage 31 horizontally mobile along guides 32 of the structure 20 under the control of an electropneumatic cylinder 33. The purpose of the shiftable idle rollers 30 is to bring the film B into the correct position relative to the batch of containers 4 above them and, when retracted (position indicated by 30' in FIG. 2), to enable the feeder 1 to be shifted transversely when one or both reels of a pair are empty and replace them with the stand-by reels 2', 3'. In place of the carriage 31 there is provided for each of the two lower reels 3, 3' a reclinable chute 34 hinged at 35 to arms 38 of the structure 20 and controlled by an electropneumatic cylinder 37. The chute 34 can be reclined into the position shown by dashed lines in FIG. 2 for the same purpose as that just described with relation to the carriage 31, i.e. to enable the structure 20 to be shifted;

2) from FIG. 3 (and also with reference to FIGS. 1 and 1A) it can be seen that the feed conveyor 5 for the batches of containers 4 comprises a stationary structure 38 provided with a projecting part 39 which extends without interference through the structure 20 of the feeder 1 for the films A, B (FIG. 1A).

The projecting part 39 comprises two parallel sidepieces 40 and a fixed horizontal surface 41 interrupted in an intermediate position at 41. On this surface there slides a conveyor belt 43 driven by a motor 44 via a belt drive 45. The conveyor belt is guided by deviation rollers 46 and is kept tensioned by a tensioning roller 47. The deviation rollers 46 located at the interruption 42 in the surface 41 are arranged in such a manner as to create a cavity 48 which the transverse bar 49 of a stop member 50 can enter to an extent that it is totally submerged, this bar being in the form of an idle roller. The position of the bar 49 when completely submerged is shown by a dashed line. When in its operating position, shown by a full line, the transverse bar 49 halts the movement of the batches of containers 4 as seen in FIG. 1. The stop member 50 is pivoted at 51 to the sidepieces 40. On it there act a return spring 52 (which tends to maintain it in the position in which its transverse bar is submerged) and an electromagnet 53 which when energized moves the member 50 into its operating or halting position.

An identical stop mechanism is provided at the free end of the projecting part 39. This mechanism is given the same reference numerals as the preceding plus a prime.

Figure 5:
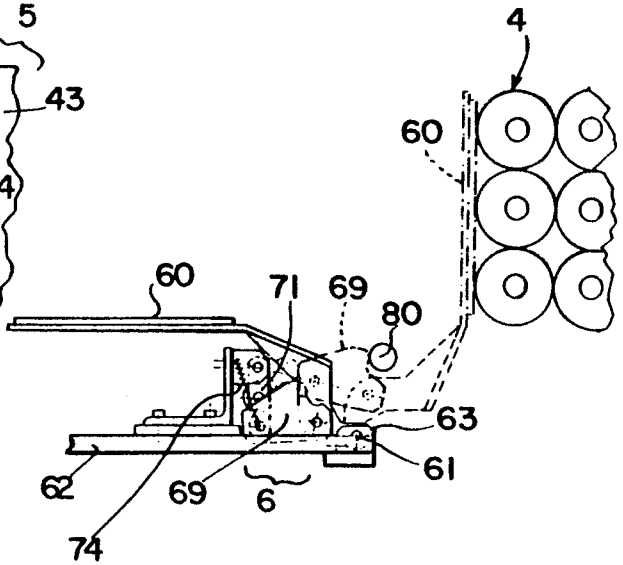
FIGS. 4 and 5 are schematic plan views, in two different positions, of the means which thrust the batches of containers from the table of FIG. 3 to the packaging section of the apparatus.
Figure 4:
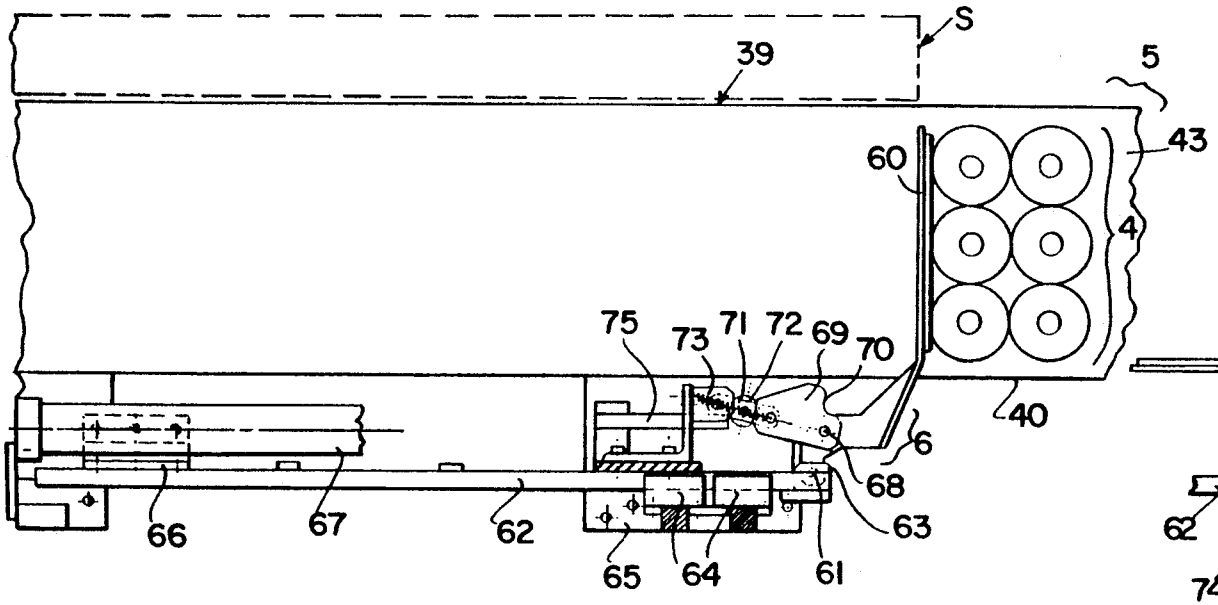

As can be seen from FIG. 1, the chute 34 of the feeder 1 for the films A, B is located downstream of the projecting part 39 of the conveyor 5 as an extension to it. To enable the batches of containers 4 to move along the chute 34 in order to reach the conveyor 8 of the operational zone 7 of the apparatus and move onto the film A and into contact with the film B to exert a pressure on this latter such as to keep it taut during the descent of the welding and cutting unit, which also further increases the tension of the already pre-stretched film (see FIG. 1, unit 11'), there are provided two identical said reciprocating pushers 6 supported by the sidepieces 40 of the feeder 5, located one on each sidepiece, one in front of the other;

3) it can be seen from FIGS. 4 and 5 how the pushers 6 (only one of which is shown in detail, the other being schematically indicated by S) are arranged relative to the conveyor 5 and how they are formed. The pusher 6 comprises a comprises a thrust arm 60 pivoted at 61 to a block 63 rigid with the end of a sliding rod 62. The rod is guided axially in adjustable supports 64 carried by a bracket 65 connected to the relative sidepiece 40 of the conveyor 5 and terminating higher than the surface of the conveyor belt 43 of this latter. The rod 62 is connected at 66 to a conventional rodless electropneumatic operating cylinder 67 rigidly connected to said sidepiece 40 by a bracket similar to the bracket 65. To the thrust arm 60 there is pivoted at 68 a connecting bar 69 having a step 70 facing the thrust arm 60. The connecting bar 69 is articulatedly connected to a support rigid with the mobile rod 62 by means of a pair of connecting rods 70 between which a roller 72 is interposed. A snap spring 74 operating under tension is connected between the connecting bar 69 and support 73. On the fixed bracket 65 there is provided a stop finger 75 arranged to collide with the roller 72 and move the thrust arm 60 from the retracted return position (shown by a full line in FIG. 5) to the operating position of FIG. 4.

In contrast, to move the thrust arm 60 from its operating position to its retracted inoperative return position so that it does not interfere either with the thrust arm 60 of the pusher S which is in its operating position and pushing the next batch of containers 4, or with the batch 4 itself, a stop 80 is provided in a fixed position at the end of the stroke of the pusher 60 (FIG. 5) so that it strikes against the step 70 of the connecting bar 69 to repeatedly cause the arm, with the aid of the spring 74, to pass into said inoperative or retracted position.

As is apparent from the aforegoing description, the two pushers 6 operate alternately, i.e. while one is pushing a batch of containers 4 (FIG. 4), the other is returning to its inoperative position (FIG. 5, part shown with the full line);

4) from FIGS. 6 to 12, and again with further reference to FIG. 1, it can be seen how the operational zone 7 and its main components, indicated by the reference numerals 8 to 16, are formed.

The service conveyor 8, on the horizontal portion of which there rest the batches of containers 4 and the film A which is to form the base of the pack for the batch of containers, carries (see FIGS. 1, 11, 12 and 13) the units 10 formed from four columns 90, arranged as the vertices of a quadrilateral.

The service conveyor comprises two lateral drive chains (FIGS. 11 and 12), the upper branches of which slide in guides 93. To the chains 92 there are connected both fillets 91 and reaction bars 94, the columns 90 being fixed to these latter, which are of greater strength. The service conveyor 8 is driven by a geared motor 95 (FIG. 1) via a chain drive 96. The reference numeral 99 indicates the driven and idle elements of the chains 92, and 97 indicates a conventional chain tensioner.

Downstream of the endless conveyor 8 there is a discharge conveyor 98 driven by the same geared motor 95 via a conventional drive, such as of belt type (not shown). The discharge conveyor conveys one pack of containers a time to the outside of the apparatus, as can be seen on the right hand side of FIG. 1, where the pack is indicated by 100.

The welding and cutting units 11 are shown in greater detail in FIGS. 9, 10, 12 and 13. With regard to FIG. 9 it should be noted that the part to the right of the dividing line K represents the entire unit 11, whereas the part to the left shows the unit with one of the headpieces and other parts removed.

The unit 11 comprises two parallel headpieces 101 connected to two parallel sidepieces 102. The sidepieces upperly carry pairs of projecting rollers 103 (see also FIG. 13), the purpose of which is to support the units in question during their recycling, as described hereinafter. At their bottom, each sidepiece 102 carries a roller 104 the purpose of which is to guide the units 11 by cooperating with fixed cams 105 (see FIG. 7), during passage from the raising section 13 to the return section of the recycling conveyor, already mentioned in relation to FIG. 1.

Below the rollers 104 the sidepieces 102 carry supports 106 which support the unit 11 during its descent and rise along the said sections 12 and 13 of the recycling conveyor. These supports are perforated for the passage of electric cables for powering two welding bars 110 (FIG. 10) contained in the unit 11 and described hereinafter.

The headpieces 101 are also provided with dragging sections 111 which by cooperating with the columns 90 (see FIG. 11) enable the units 11 to be dragged by the service conveyor 8.

Figure 10:
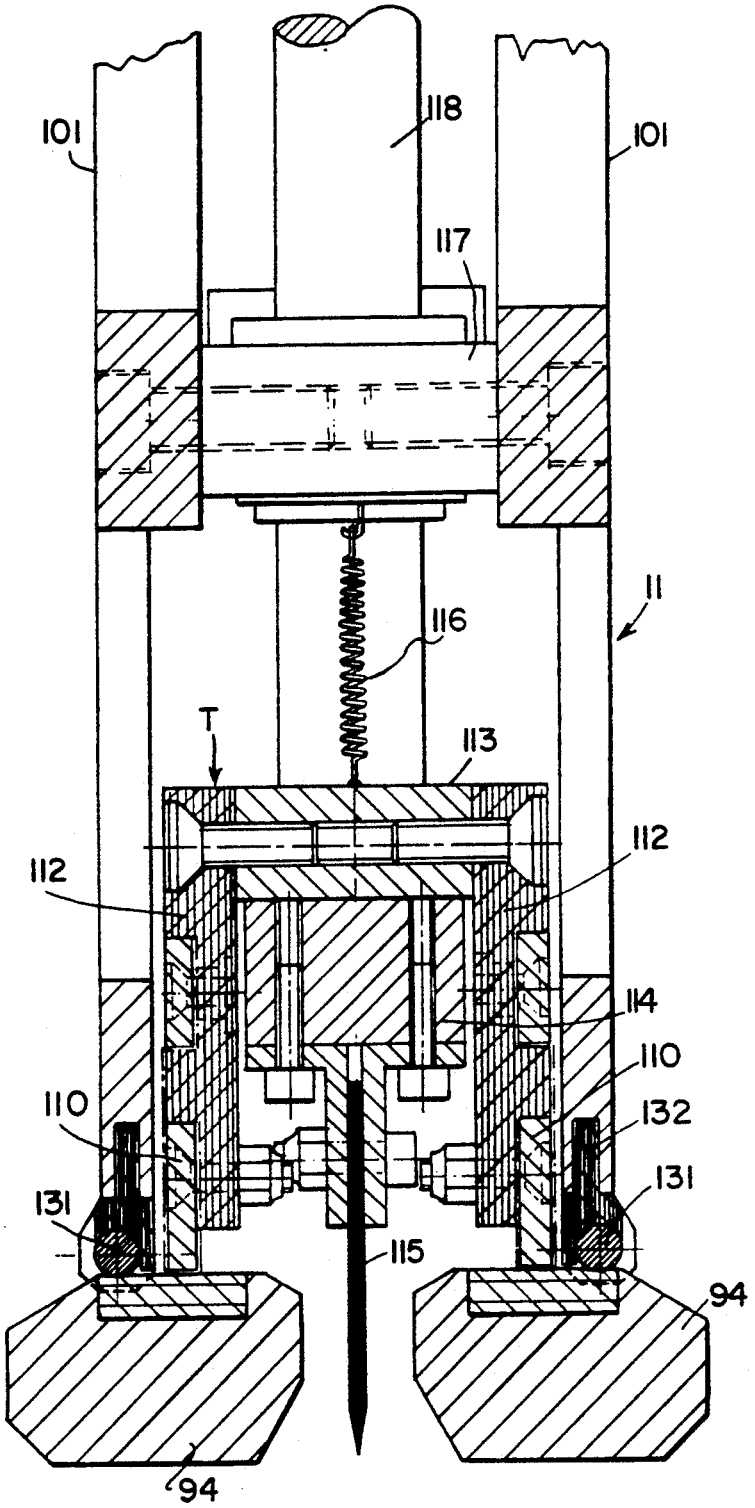
FIG. 10 is a section on the line A—A of FIG. 9.
Figure 11:
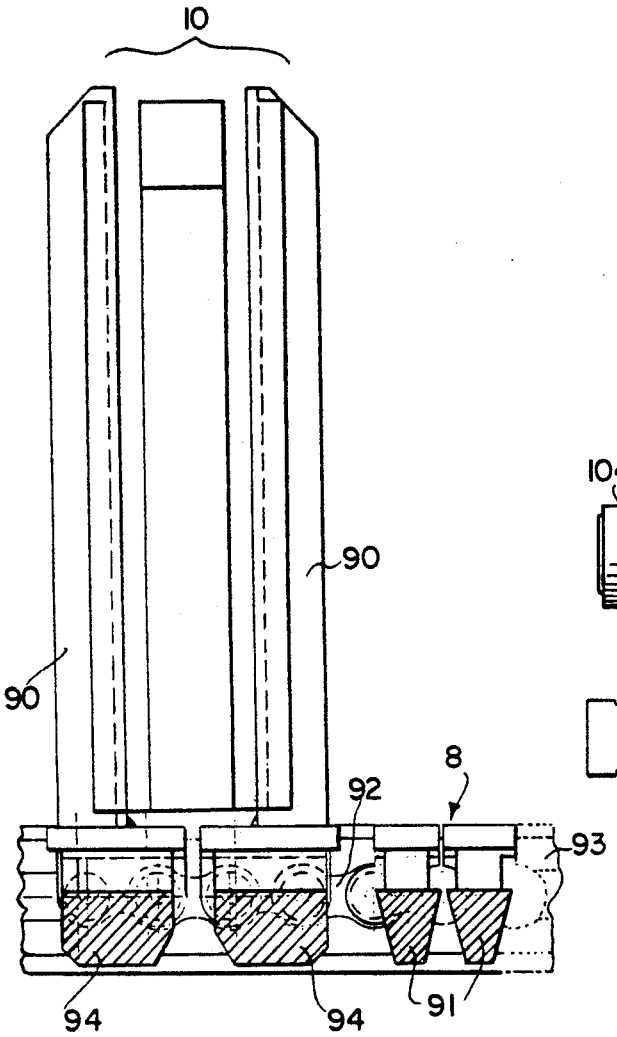
FIG. 11 is a vertical longitudinal section through a detail of the service conveyor with the relative means for guiding and driving the welding and cutting units.
Figure 12:
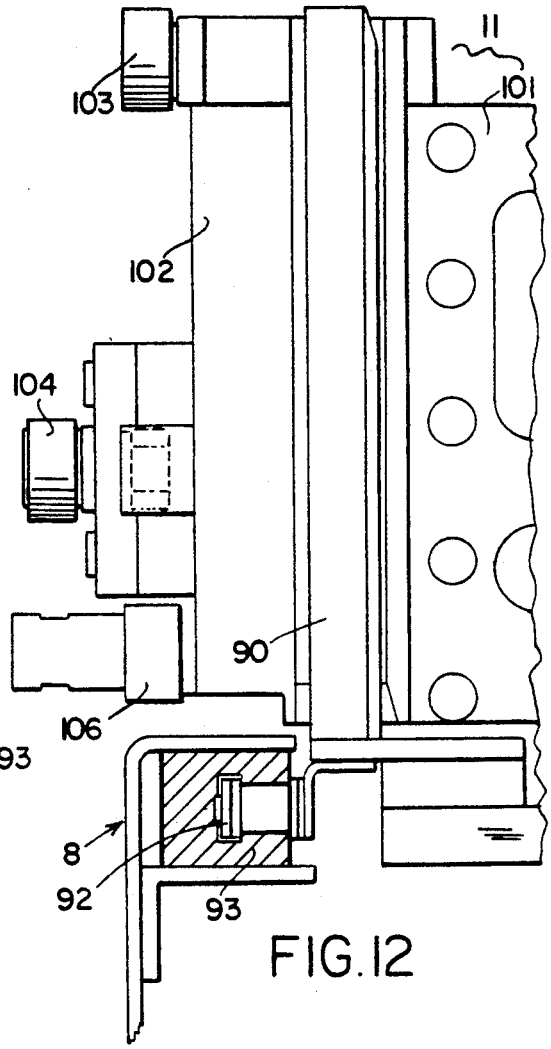
FIGS. 12 and 13 are schematic views in partial elevation and plan respectively, showing the means of FIG. 11 when they receive the welding and cutting units of FIGS. 9 and 10.
Figure 13:
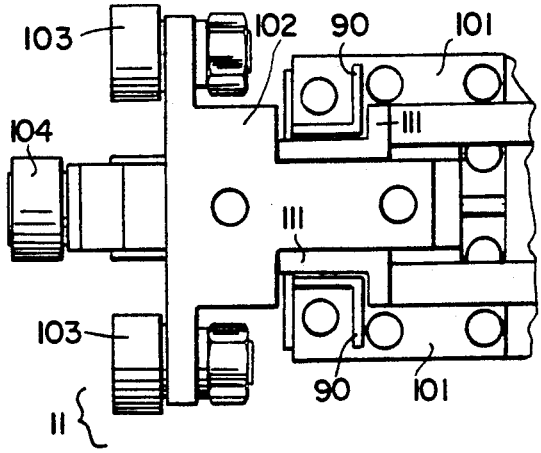

As can be seen from FIG. 10, the welding bars 110 are mounted in support plates 112 fixed to a spacer 113 to which, in an intermediate position between the welding bars, there is fixed a support 114 for a blade 115 which projects beyond the bars. The blade 115 and bars 110 therefore form part of a mobile operating head T. Return springs 116 are fixed to the spacer 113 and also to spacers 117 which join together the two headpieces 101 of the unit 11.

Rods 118 are rigid with the spacer 113 and slide in holes in the spacers 117 and in other spacers 119 situated further down. The rods 118 pass through holes in a cross-member 120 and are connected together upperly by a cross-member 121 which carries thrust rollers 122 intended to cooperate with the guides 15 (see also FIG. 1) to effect the welding and cutting of the films A, B.

The cross-member 120 is also provided with rollers 123 (external to the rollers 122) and is rigid with rods 124. These rods can slide in holes in spacers 125 (which join together the headpieces 101) against the action of compression springs 126 which act on a lower spring guide 127 resting on the relative spacer 125, and on a sleeve 128 rigid with the rod 124. The rollers 123 are intended to cooperate with the guides 16 to elastically urge the headpieces 101 against the reaction bars 94 of the service conveyor 8 to clamp the films A, B under tension during the cutting, welding and cooling stages. To ensure optimum sliding of the film B during the stage in which the unit 11 is descending (see FIG. 1, unit indicated by 11') towards the service conveyor 8, rollers 131 are mounted and retained on the lower edge of the headpieces 101 and are partly surrounded by an insert 132 of material of low friction coefficient or self-lubricating, such as teflon.

Figure 6:
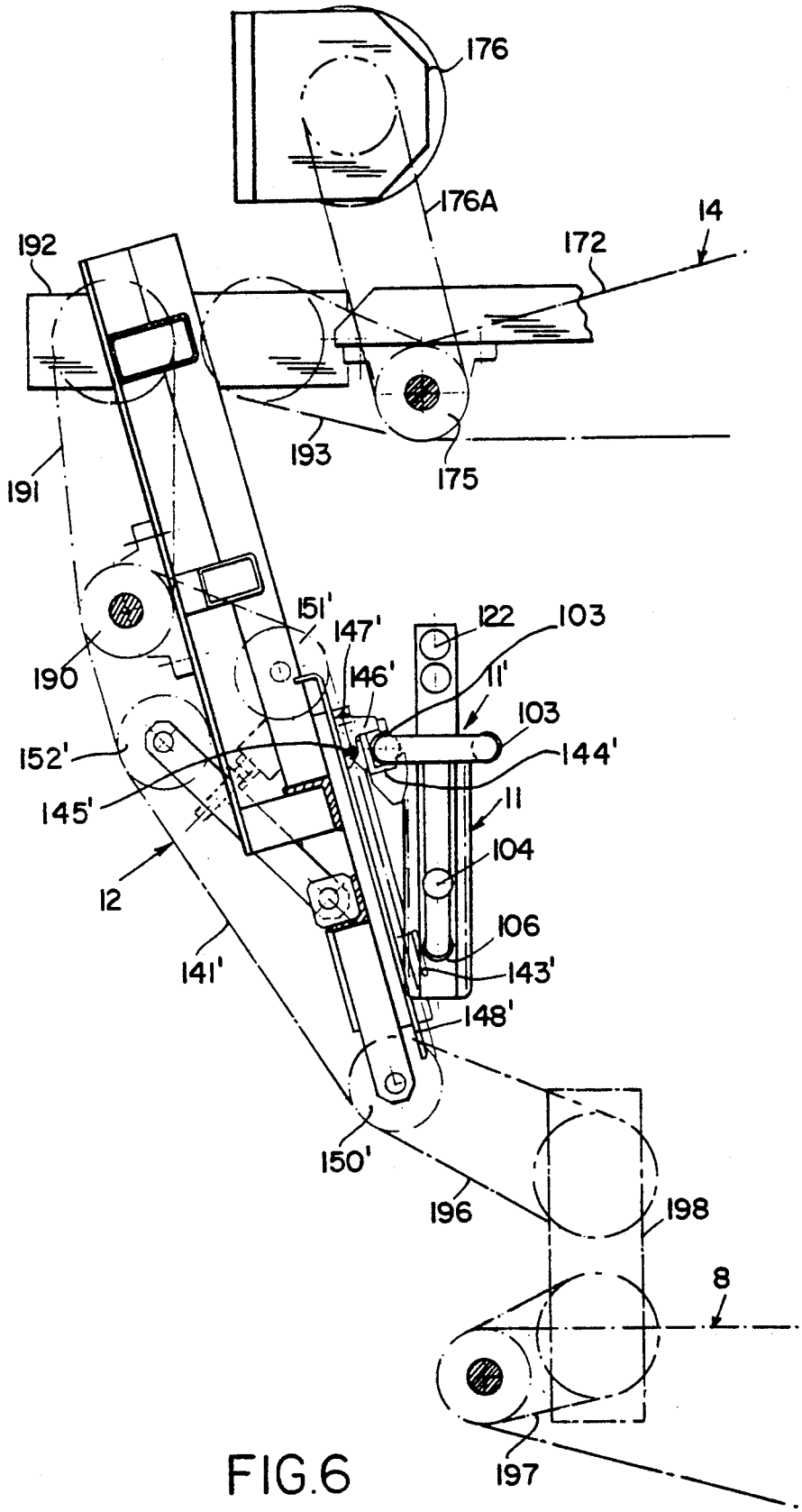
FIGS. 6, 7 and 8 are schematic side elevational views, with parts shown in section, of the mutually cooperating means which recycle the welding and cutting units.
Figure 7:
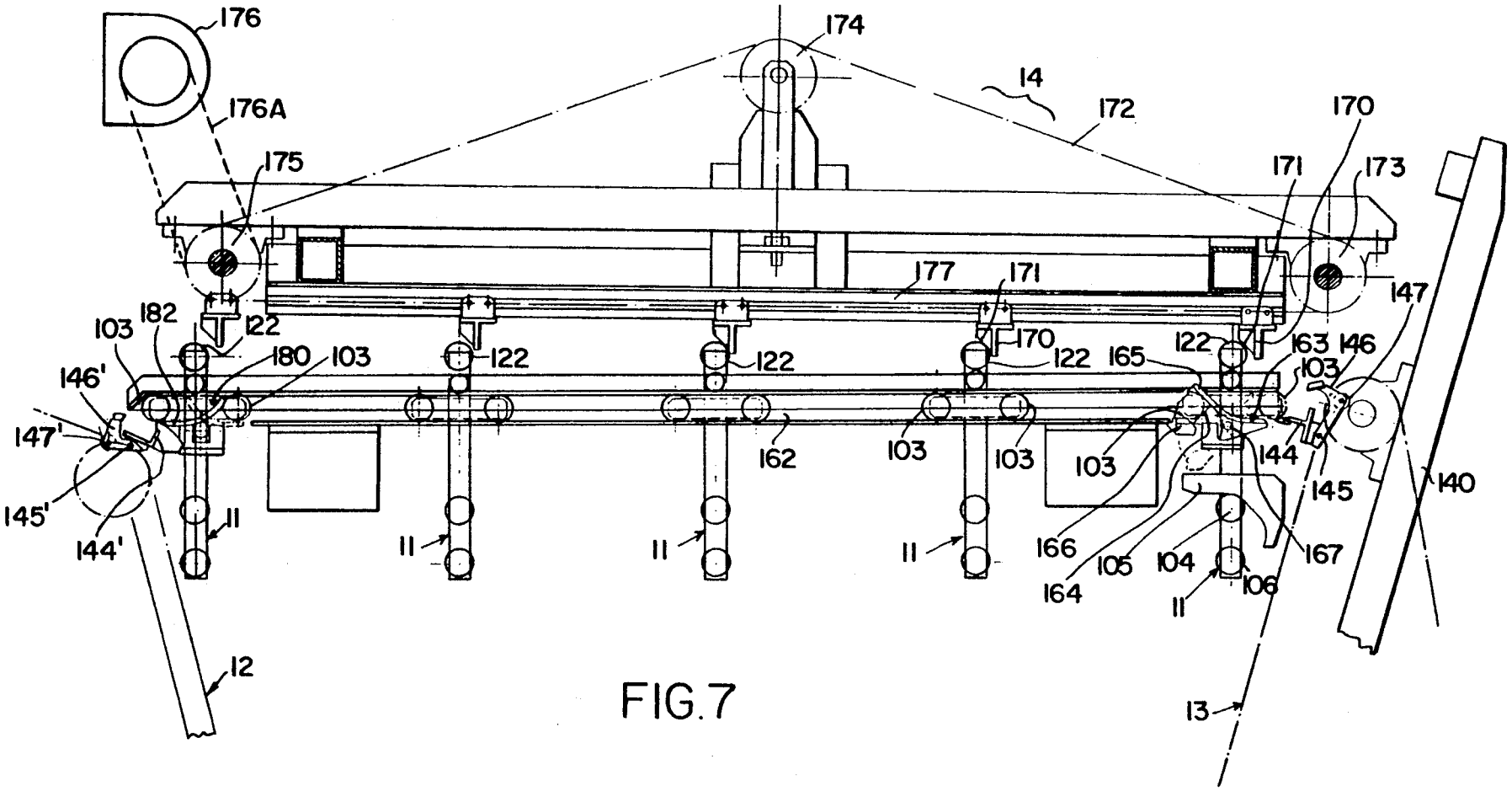
Figure 8:
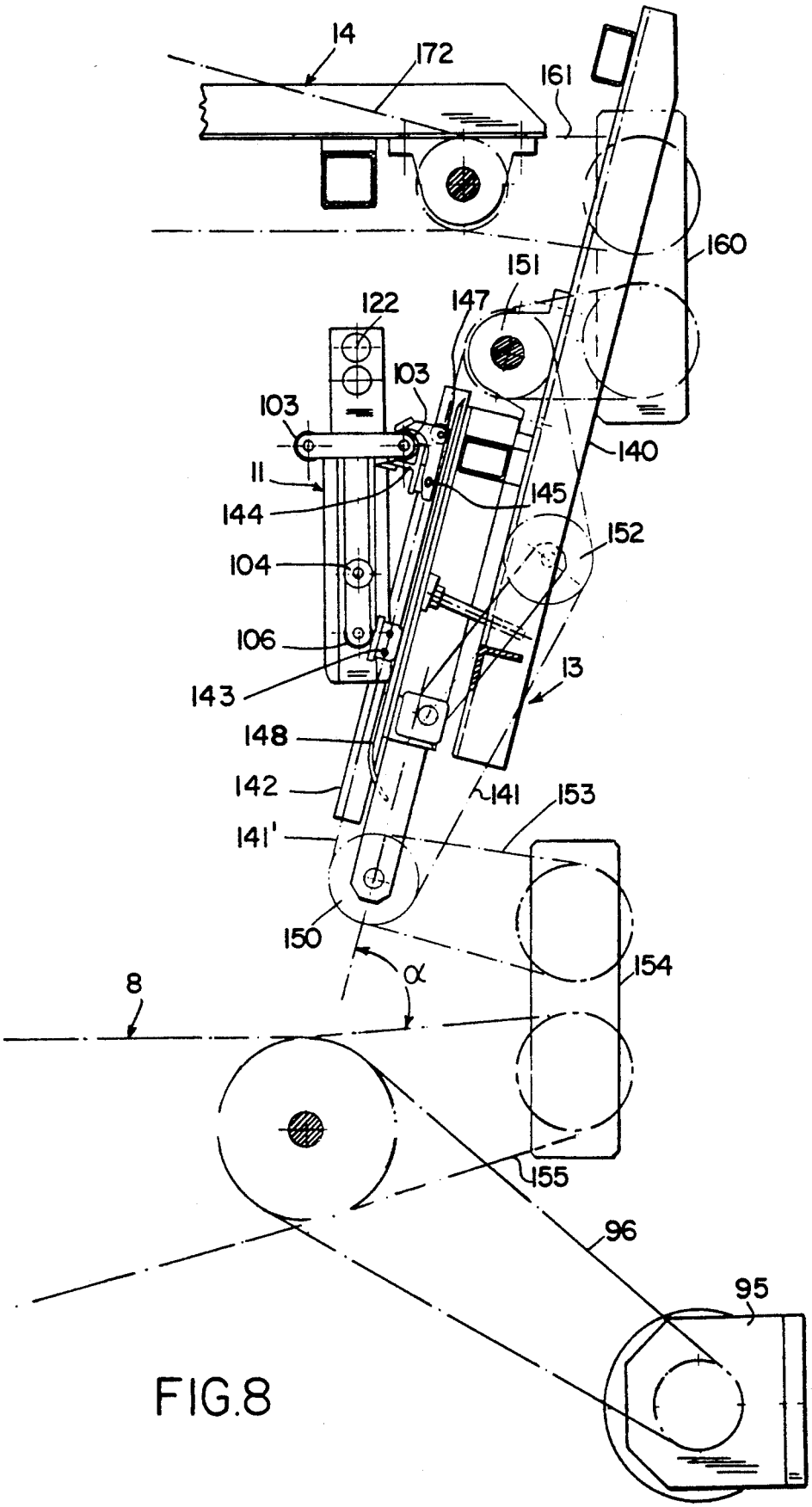
Figure 9:
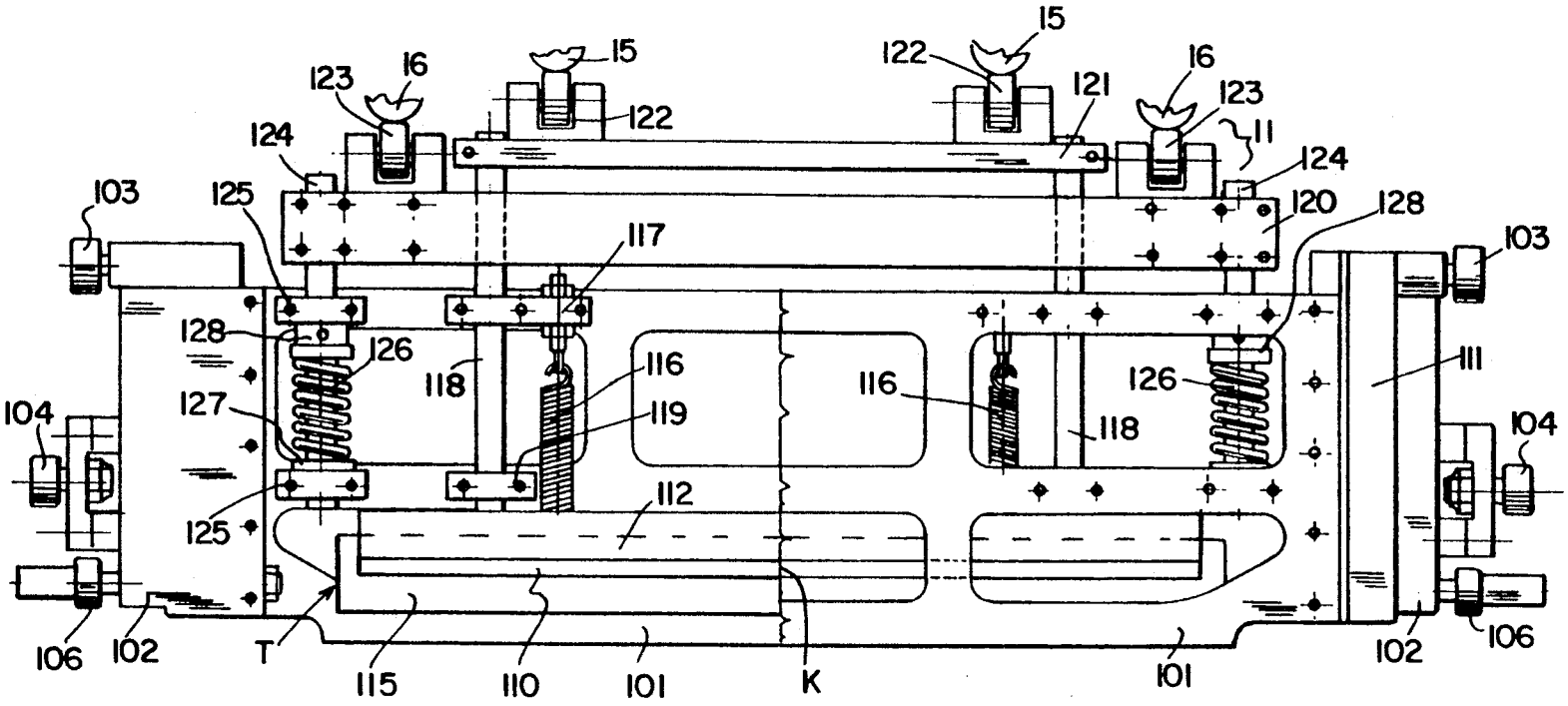
FIG. 9 is an elevational view of a welding and cutting unit.

The recycling conveyor for the units 11 comprises, as already stated, three sections 12, 13, 14, which are shown in greater detail in FIGS. 6, 7 and 8. When cutting, welding and cooling are complete, ie on leaving the service conveyor 8, the unit 11 has performed its function and is therefore extracted from the group of columns 10 in which it is located, and is returned to the entrance to this conveyor for reuse. To extract it the raising section 13 (FIGS. 1 and 8) is used. This section is inclined to the vertical and forms an acute angle with the discharge conveyor 98. This section is also supported by the apparatus frame via a framework 140 and comprises a conveyor formed from two endless parallel drive chains 141, the active branches of which slide in straight guides 142, their speed exceeding that of the conveyor 8. Support blocks and engagement means for the rollers 103 located on one side of the unit 11 are connected to the chains. These engagement means comprise a support part 144 substantially of T profile, to which a crank lever 146 is pivoted at 145 and is provided at its crank with a roller 147 which when along the active part 141' of the chains rests against a fixed guide 148 so that the rollers of the unit 11 and the unit itself are gripped between the support part 144 and the lever 146, as shown in FIG. 8.

The chains 141 pass about sprockets 150, 151 and 152. The sprockets 151 are idle, the sprockets 152 keep the chains under tension, and the sprockets 150 are driven by a chain drive 153 via a reversible reduction gear 154 which is itself driven by a chain drive 155 from the geared motor 95 via the drive 96 which controls the conveyor 8.

By means of a further reversible reduction gear 160, motion is transmitted to the return section 14 (FIGS. 1 and 8) via a chain drive 161.

The return section 14 (FIG. 7) comprises parallel guides 162 which are slightly inclined to the horizontal in an upward direction from the section 13 to the section 12. The rollers 103 of the welding and cutting units 11 slide in these guides after leaving the raising section 13. To enable the rollers 103 to properly enter the guides 162, fixed cams 105 are provided at the commencement of these (right side of FIG. 7) to cooperate with the rollers 104 and deviators 163 associated with these guides. The deviators 163 (which when in their inoperative position assume the attitude shown by full lines) comprise a guide channel 164, an upper arcuate plate 165 and a profiled connection piece 166, and are pivoted at 167 to a fixed part of the apparatus structure. Close to the end of the rising movement, the front rollers 103 of the welding and cutting units 11 enter the channels 164 of the deviators 163 in the position shown by the full line in FIG. 7, and then enter the guides 162. The rear rollers 103 reach the level of the guides 162 and the lever 146 becomes free as its roller 147 no longer rests on the surface 148. The rear rollers 103 of the unit 11 then become free and are dragged into the guides 162, passing over the hinged curved plate 165 which moves into the position shown by the dashed line, to then return to its rest position by the action of a return spring (not shown) after passage of the rear rollers 103, as the rollers 122 of the unit 11 are engaged by prongs 170 (having an inclined front face 171) which are connected to chains 172 driven by the drive 161 (FIG. 8). The chains 172 pass over the sprockets 173, 174, 175. The sprockets 174 tension the chains in question. The sprockets 175 are also driven by a geared motor 176 identical to the geared motor 95 (FIG. 8) via a chain drive 176A.

The chains 172, along the section between the sprockets 173, 175, are guided in parallel straight guides 177 also inclined to the horizontal and to the guides 162, in the direction upward from the sprockets 173 to the sprockets 175. Consequently, the prongs 170 tend to withdraw from the rollers 122 on which they act.

At the exit end of the guides 162 there is provided a deviator 180 hinged at 181 and comprising an arcuate plate 182. The deviator 180 can assume two end-of-travel positions, one shown by full lines and the other by dashed lines. The inoperative position is that shown by dashed lines. The front rollers 103 of the unit 11 leaving the guides 162 cause the deviator to rotate so that those behind it do not proceed along the guides 162 but instead move downwards. The front rollers are seized (FIG. 7) by the lowering section (FIG. 6) which substantially coincides with the raising section 13, but is inclined in the opposite direction (see FIGS. 1 and 6). Because of this similarity, identical or similar members of the lowering section are indicated by the same reference numerals plus a prime. The most appreciable differences are that the chains 141' pass over further sprockets 190 which receive motion from a chain drive 191 via a reversible reduction gear 192, which is driven by the chains 172 via a chain drive 193. A further difference, although purely formal, is that during the descent of the units 11 it is their front rollers 103 which are engaged by the chains 41' via the members 144' and 146'.

The descent movement of the unit 11 has a vertical component and a horizontal component, this latter in the direction of movement of the conveyor 8. After contacting the film B (which is thus dragged and stretched), the unit 11 enters an underlying group of moving columns 10. When this has occurred, the support 143' withdraws from the supports 106 and the unit is then abandoned by the lowering section 12 when the members 144' and 146' move along the deviation sprockets 150' and the rollers 147' of the member 146' abandon the reaction surface 148'. The sprockets 150' are operationally connected to the service conveyor 8 via chain drives 196 and 197 and a reversible reduction gear 198.

The various said reduction gears are gearboxes comprising two pairs of gear wheels having a reduction ratio matched to the different speeds of the service conveyors 8 and of the return section 14 relative to the raising section 13 and to the lowering section 12. These reduction gears can be used either to step down or to step up the speed and are utilized to connect together the four conveyors (8, 14, 13, 12) to thus ensure perfect synchronization of the entire system, which is driven by two geared motors 95 and 176.

The operation is as follows.

The batch of containers 4 originating from any production line reaches the feed conveyor 5, which is provided with retaining guides, not shown, and driven with continuous motion. The two spaced-apart stops 49 and 49' are raised on the conveyor 5. The batch of containers 4 halts against the stop 49 while a preceding batch is in contact with the stop 49'. The reciprocating pushers 6, which are active during the pushing stage but are folded back and therefore inactive during their return, are inserted alternately between the two stops 49, 49'.

When the stop 49 is engaged by the batch of containers 4, both the stops turn downwards to allow the two batches 4 to proceed, and the pusher 6 is simultaneously operated to act on the batch 4 which is in contact with the stop 49'. When the batches 4 have passed beyond the respective stops 49, 49', these rise immediately, so that the batch 4 located further upstream halts against the stop 49', whereas the downstream batch reaches the service conveyor 8 under the action of the pusher, by passing along the connection chute 34.

At the entry to the service conveyor 8 it meets the film A which extends tautly along the conveyor, the film B extending tautly substantially vertically.

The pusher 6 urges the batch 4 into contact with the welding and cutting unit 11 which, as heretofore described, has been inserted between the group of columns 10, and therefore moves with the service conveyor 8.

This movement ensures that the upper film B is under tension against the front side of the batch of containers 4. The pusher follows the movement of the welding and cutting unit 11 until the next unit 11' comes into contact with the film B which by being dragged by the moving batch of containers 4 has been brought into an approximately horizontal position.

It should be noted that when that welding and cutting unit which is descending by the action of the lowering section 12 for insertion into the corresponding upright group 10 comes into contact with the film B, the pusher 6 strikes the stop 80 (FIG. 5) which overturns to reverse its travel direction to prevent collision with the descending welding and cutting unit 11'. While this pusher recedes, the other is activated and moves after the lowering of the stop 49', to commence the next recycle. The welding and cutting unit 11' descends completely into the group of columns of the conveyor 8, to drag the film B and stretch it, and then clamp it by means of its headpieces 101 (see FIG. 10) against the film A and against the reaction bars 94 of the conveyor. The batch of containers 4 is at this point surrounded by the films A and B.

As the welding and cutting unit 11' advances, it is ensured that pressure is exerted by its headpieces 101 on the reaction bars 94 by the presence of the straight guides 16, which act on the rollers 123 (see FIGS. 1 and 9) of the units 11 and extend along a substantial longitudinal portion of the conveyor 8. After this pressure begins to be exerted via the tracks 16, the shorter-length tracks 15 acting on the rollers 122 of the unit 11 (FIGS. 1 and 9) lower the operating head of the unit, this head comprising (FIG. 10) the blade 115 and the welding bars 110. When the two films A and B have been cut and welded, the head (115, 110) retracts to allow the welds to cool.

At the end of the service conveyor 8 the unit 11 leaves the pressurizing guides 16 and its rollers 103 become inserted between the members 144, 147 of the raising section 13, which raises it, releasing the now wrapped batch of containers 4, which continues onto the discharge conveyor 98. The unit 11 then reaches the return section 14 and the lowering section 12, as described. During this handling, the other units 11 are inserted upstream of the service conveyor 8 at regular intervals.

Specifically, the unit 11 withdrawn from the raising section 13 is fed onto the slide guides 162 of the return section 14, and the lowering section 12 reinserts it into the operating recycle. This carousel system for the welding units 11, the number and relative speed of which can be varied according to production requirements, ensures a regular and continuous rate of packaged containers, a rate which can reach levels much higher than those obtainable with the conventional art.

Figure 14:
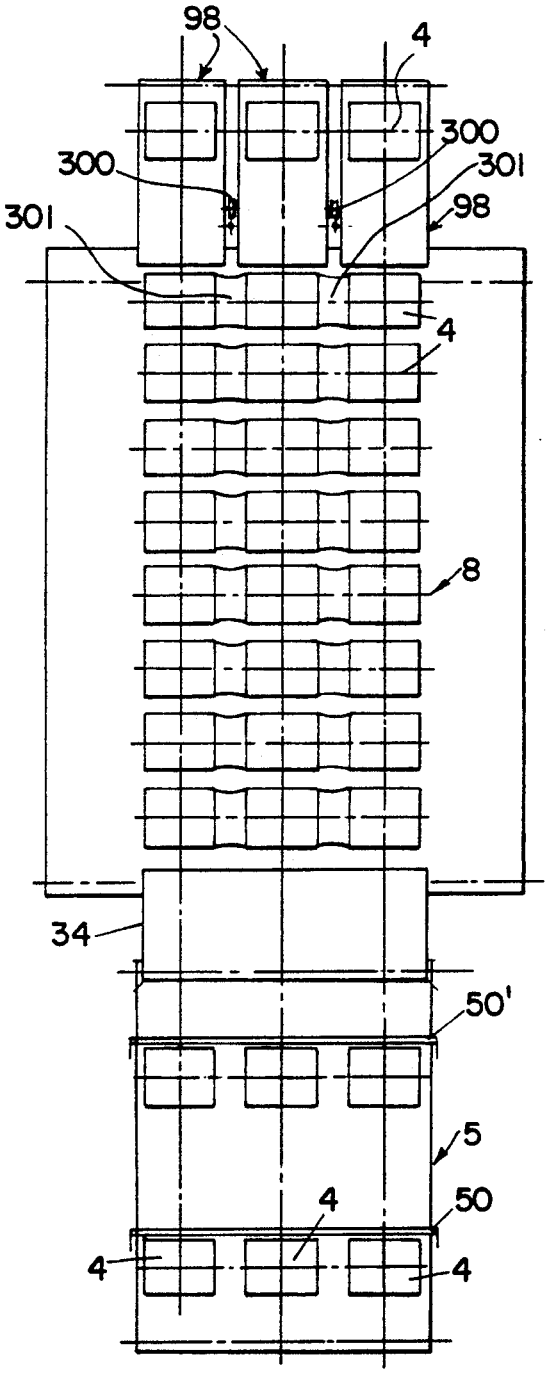
FIG. 14 is a schematic plan view of a modified embodiment of the apparatus able to form a pack three times the size of that of the apparatus of the preceding figures.
Figure 15:
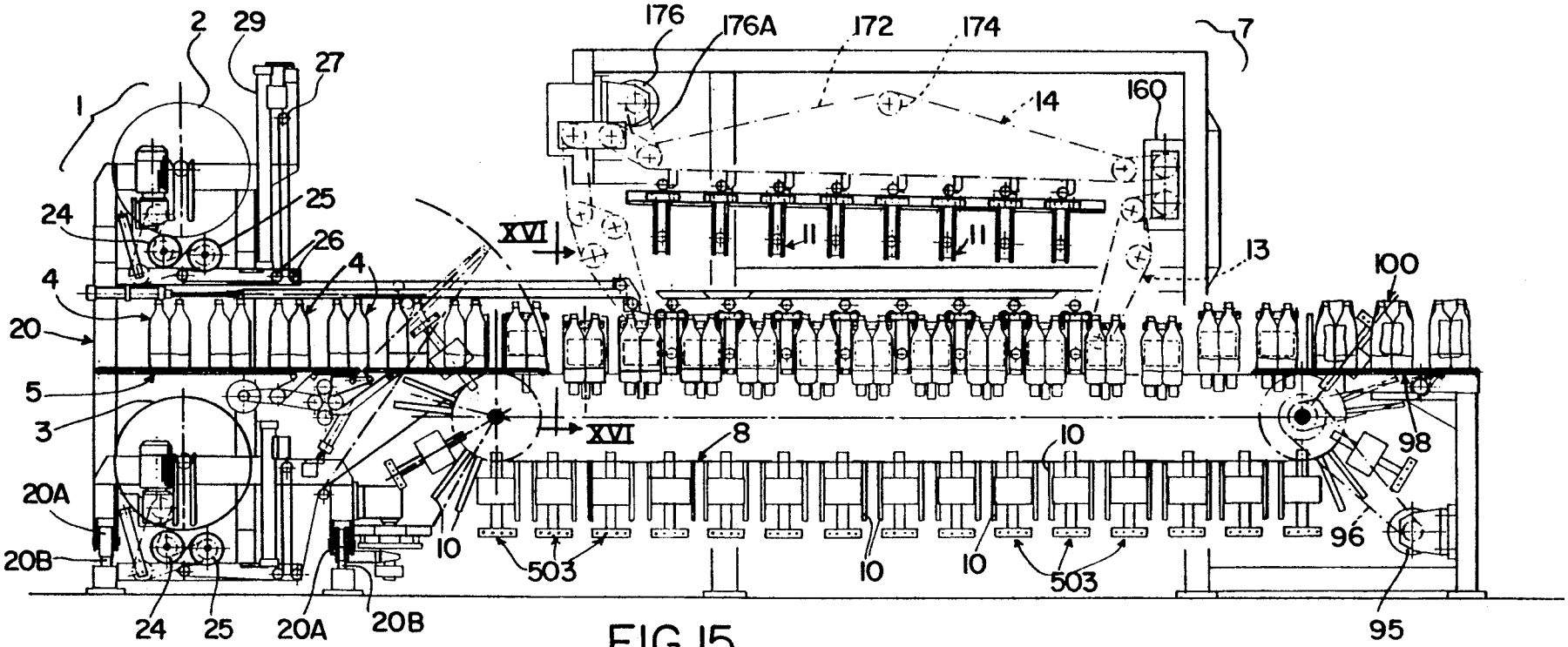
FIG. 15 is a schematic side elevational view of a further modification of the apparatus of FIG. 1.

As shown schematically by the plan view of FIG. 14, the inventive concept can be implemented in an apparatus able to operate at a production rate higher than that of the aforedescribed apparatus. In FIG. 14 it can be seen that the feed conveyor 5 is able to receive and handle three side-by-side batches of containers 4. With the conveyor 5 there cooperate stops 50, 50' and pushers (not shown for simplicity) which transfer the three batches 4 onto the service conveyor 8 via the chute 34 of the film feeder (also not shown but comprising reels and therefore films of a sufficient width to embrace the three batches 4). An operational zone similar to the described zone 7 is provided but with the difference that the unit 11 has a total width sufficient to cut and weld all three side-by side batches 4. At the exit of the service conveyor 8 there are provided three spaced-apart discharge conveyors 98, between which there are two cutting members of blade or electrical resistance type 300, which cut the films where (at 301) the three side-by-side packaged batches 4 are joined together, to separate these batches from each other.

A different embodiment of the apparatus according to the invention is shown in FIGS. 15 to 18. In these figures, parts corresponding to those of the preceding figures are indicated by the same reference numerals.

In the modified embodiment under examination, the batches of containers 4 are not fed to the operational zone 7 by the use of the reciprocating pushers 6 but instead are fed at constant pitch and with uniform speed.

This is attained by partially "caging" the batches 4.

For this purpose, the service conveyor 8 carries, on two of its opposing sides 501 and 502, retention elements or members 503 disposed in suitable positions between the columns 10 associated with said conveyor 8.

The retention members 503, which are positioned symmetrically on the two said sides of the conveyor 8, each comprise a hollow tubular element 504 carrying a substantially flat plate 505; this plate is able to position itself on one side of the batch of containers 4 and comprises slightly bent lateral ends 506 and 507 to at least partly embrace the end containers of each batch 4. Specifically, each plate 505 is associated with a substantially L-shaped arm 508 retained in known manner against a further arm 511. Both said arms can slide within the hollow tubular element 504 which for this purpose acts as a guide for the sliding movement. The arm 508 is slidingly inserted into an enlarged part 509 present at one end 510 of each tubular element 504. In contrast, the arm 511 projects from both ends of the tubular element 504 (upperly and lowerly in FIG. 16) and carries at its (with reference to FIG. 16) upper free end 512 a member 513 which supports a plurality of parallel fingers 514 which project perpendicularly from said support 513. At its lower free end 515 the arm 511 carries a roller 516 arranged to cooperate with guides 517 fixed to any supporting part of the apparatus according to the invention and disposed within the structure of the service conveyor.

Figure 16:
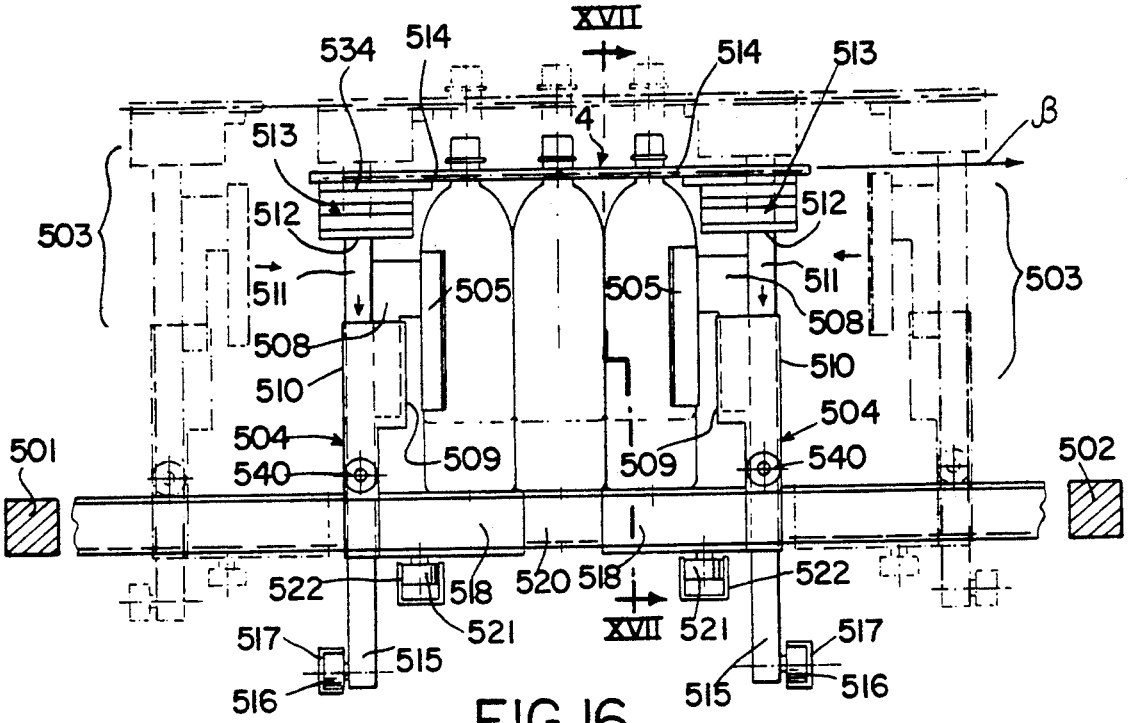
FIG. 16 is a schematic section on the line XVI—XVI o FIG. 15 with some parts omitted for clarity.
Figure 17:
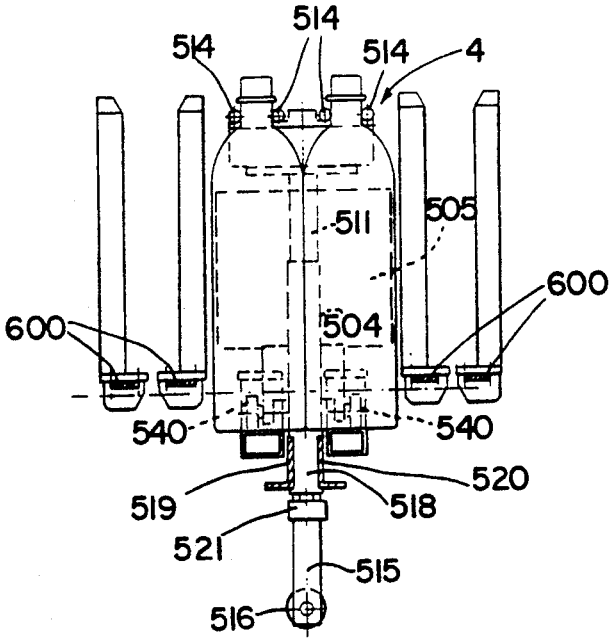
FIG. 17 is a schematic section on the line XVII—X-VII of FIG. 16.

The guides 517 are constructed in such a manner that their cooperation with the rollers 516 of the retention members 503 causes the arms 511 to slide in the respective tubular elements or guides 504. In FIG. 16 the raised position of the arms 511 is shown by dashed lines and their lowered position by full lines. Each tubular element or guide 504 is connected to a slide 518 slidable between substantially L-shaped guides 519 and 520 fixed to the lateral dragging chains 92 (not shown) of the service conveyor 8.

Each slide 518 carries a roller arranged to cooperate with a respective guide 522 fixedly supported by the structure of the apparatus under examination. Each guide 522 is formed in such a manner that its cooperation with the corresponding roller causes the slide 518 to slide along the guides 519 and 520, to thus cause the retention members 503 to approach or withdraw from each other. In FIG. 16 a mutually withdrawn position of the members 503 is shown by dashed lines, and their mutually approached position is shown by full lines.

As stated, the fingers 514 are carried by members 513 rigid with the arms 511. Specifically, said fingers are connected together in pairs by at least one articulated system comprising elements 530 and 531 (see FIGS. 18 and 19) hinged together at 532 and hinged at 533 to supports 546 for the fingers. The hinging point 532 (formed for example by a suitable pin) is fixed to plates 534 and to a plate 545 positioned below the plates 534 in each support member 513.

The plates 534 are disposed (see FIG. 19) to the side of the fingers 514, on the supports or further plates 546 to which pins defining the hinges 533 are connected, as are the fingers themselves.

Finally, rollers 540 are associated with the tubular element or guide 504, and are slidable on the fillets 91 to prevent swaying of said guides (and hence of the arms 508 and 511) during the conveying of a batch of containers 4.

It will now be assumed that the apparatus according to the present modified embodiment of the invention is to be operated.

At the end of the feeder 5, the rollers 521 make contact with the guides 522. The cooperation between these members causes the slides 518 to slide (horizontally in FIG. 16) along the fixed guides 519 and 520, consequently causing the fingers 514 to approach each other until they come into mutual contact. The members 503 therefore pass from the position shown by dashed lines in FIG. 16 to the position shown by full lines. As a result of the contact, the fingers move along their axis (arrow B in FIG. 16) and approach each other due to the presence of the elements 530 and 531, which together with the fingers 514 define an articulated parallelogram and tend to rotate about the hinges 532. In this manner the fingers grip the containers of the batch 4. If the movement of the retention members and the movement of the batches of containers 4 are synchronized in known manner, said fingers 514 position themselves between the containers and grip against them to form a sort of cage to prevent them swaying during their packaging and hindering the actual packaging operation. After the members 503 have approached each other, the cooperation between the rollers 516 and guides 517 causes the thus formed cage to move (downwards in FIG. 16). This lowering of the batch of containers 4 causes stretching of the plastics packaging film A. If the welding units 11 are now operated, they weld the films in zones raised from the bottom of the containers.

It should also be noted that the downward movement of the batch of containers 4 (or alternatively the upward movement of the reaction bars) causes the lower film A to assume the shape of the container bases by the effect of further stretching.

Finally, it should be noted that the fillets 91 are at a lower level than the reaction bars 94, these latter comprising seats for the container bases.

When the packs have been formed, the guides 517 cooperate with the rollers 516 to raise the arms 511, after which the slides 518 are guided away by the rollers 521.

Figure 18:
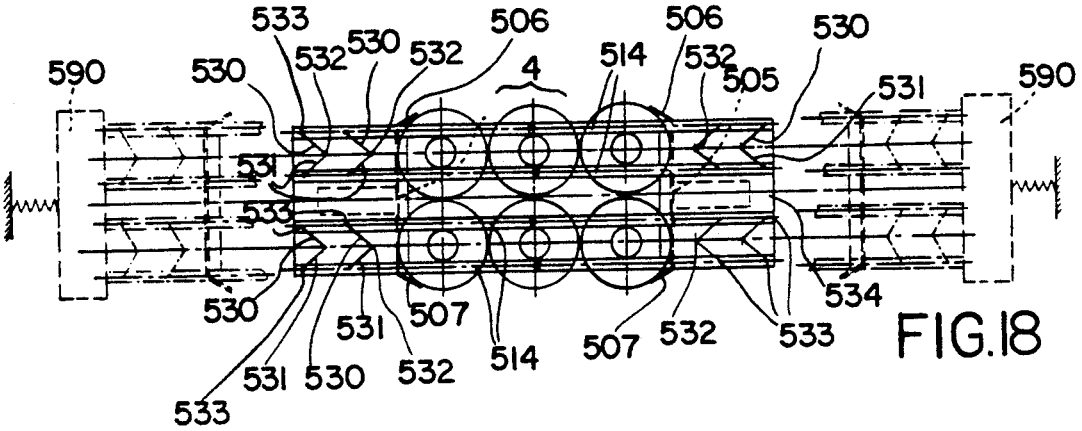
FIG. 18 is a schematic plan view of part of the apparatus shown in FIG. 16.
Figure 19:
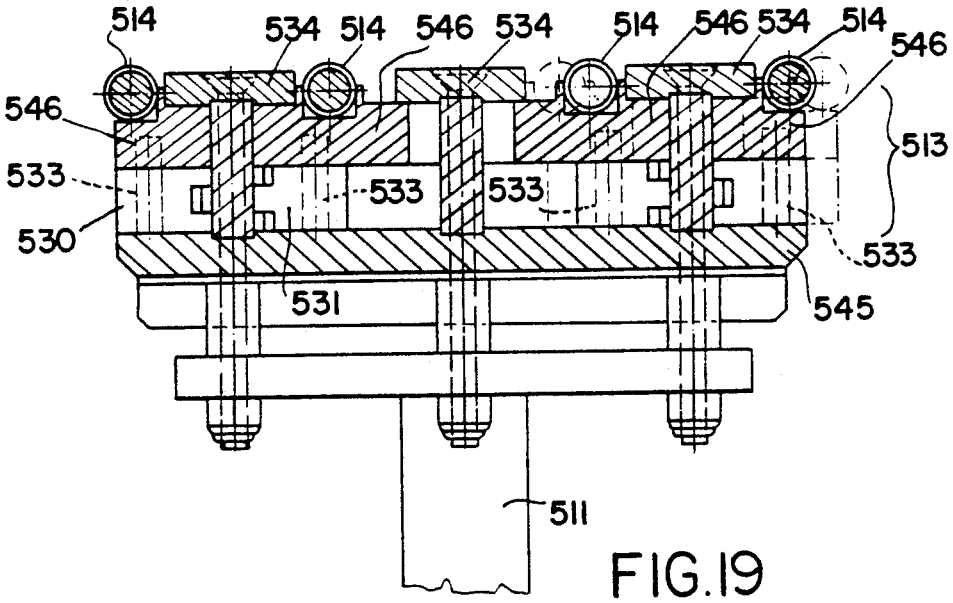
FIG. 19 is a section on the line XIX—XIX of FIG. 18.

In addition, pressing plates (or other elastic elements such as springs or the like) shown schematically in FIG. 18 and indicated by 590, they being associated with each member 503 and in particular fixed to the support element 513 (not shown for reasons of clarity in FIG. 16), act on the fingers 514 in the opposite direction to the arrow B of FIG. 16, to cause them to withdraw from each other in a manner similar to that described for their mutual approach. The batches of containers 4 then pass to the discharge conveyor 98 in known manner.

An apparatus according to this described embodiment enables improved packaging of the containers to be obtained, and prevents them overturning or generally swaying during their movement, while maintaining the containers in well grouped and compact positions and preventing them from moving apart or deforming even when the film tension is high.

Finally, the feed is continuous, of constant speed and at regular intervals.

The invention also has the advantage that films A, B with different characteristics can be used, such as one being self-adhesive and the other not, and/or one being thicker than the other.

I claim:

1. A method for the continuous packaging of batches of items (4) to be packaged using elastic plastic wrapping material, comprising the steps of:

serially and continuously positioning a plurality of said batches of items (4) to be packaged on a base film (A) carried on a common service conveyor (8);

interposing a welding and cutting unit (11) between each batch of items (4) and drivingly engaging said unit with said common service conveyor;

continually moving, along a prescribed path, said base film (A), said batches of items (4) positioned on said base film (A), and said interposed welding and cutting units (11) by said common service conveyor (8), while covering said batches with a covering film (B);

welding, transversely to said path, said covering film (B) to said base film (A) between each batch of items (4) and the next batch of items (4);

cutting said films (A) and (B) transversely of said path and at a location to leave portions of welded films (A) and (B) on each side of the cut; and recycling said welding and cutting units (11) by removing them from said service conveyor (8) after said welding and cutting steps, and returning said units (11) onto said service conveyor at a position preceding the welding and cutting operations of said units in said interposing step.

2. A method as claimed in claim 1, characterised in that the two films (A) and (B) have different physical characteristics.

3. The method as claimed in claim 1, using self adhesive or non-self adhesive films of elastic plastic material in a stretched or prestretched state, and wherein:

said welding step includes welding, transversely to said path, said covering film (B) to said base film (A) in two spaced-apart positions between each batch of items (4) and the next batch of items (4); and said cutting step includes cutting said films (A) and (B) transversely of said path along a line intermediate said two spaced-apart positions.

4. An apparatus for the continuous packaging of batches of items (4) to be packaged using elastic plastic wrapping material, comprising:

a source of base film (A);

an endless service conveyor (8) for carrying said base film;

a source of covering film (B);

a plurality of movable welding and cutting units (11);

means for serially and continuously positioning a plurality of said batches of items (4) to be packaged on the base film (A) on said service conveyor;

means for interposing one of said movable welding and cutting units (11) between each batch of items (4) in driving engagement with said service conveyor, each said welding and cutting unit (11) including means for welding, transversely to said path, said covering film (B) to said base film (A) between each batch of items (A) and the next batch of items (4), each said welding and cutting unit (11) further including means for cutting said films (A) and (B) transversely of said path and at a location to leave portions of welded films (A) and (B) on each side of the cut;

said endless service conveyor (8) hauing means for continually moving, along a prescribed path, said base film (A), said batches of items (4) positioned on said based film (A), and said interposed welding and cutting units (11);

means for covering said batches of items (4) with a covering film (B) while said items (4) are being conveyed on said endless service conveyor (8); and a recycling conveyor (12, 13, 14) for recycling said welding and cutting units (11) by removing them from said service conveyor, after said welding and cutting units (11) have performed their welding and cutting operations, and relocating said welding and cutting units (11) on said service conveyor (8) at a position preceding the welding and cutting operations of said units (11) for acting upon by said means for interposing.

5. An apparatus as claimed in claim 4, using self adhesive or non-self adhesive films of elastic plastic material in a stretched or prestretched state, and wherein:

each of said plurality of welding means includes means for welding said covering film (B) to said base film (A) in two spacedapart positions between each batch of items (4) and the next batch of items (4); and each of said plurality of means for cutting includes means for cutting said films (A) and (B) along a line intermediate said two spaced-apart positions.

6. An apparatus as claimed in claim 5, wherein the welding and cutting units (11) comprise presser means (101) for the films (A, B), to exert a pressure on the films (A,B) externally to the positions in which the welds are made.

7. An apparatus as claimed in claim 4, wherein the welding and cutting units (11) comprise two electrically heated parallel welding bars (110) and an intermediate cutting knife (115), forming a mobile operating head in which the welding bars (110) and knife (115) are mobile relative to each other.

8. An apparatus as claimed in claim 7, wherein the welding and cutting units (11) comprise presser means (101) for the films (A,B), to exert a pressure on the films (A,B) externally to the positions in which the welds are made and wherein the presser means (101) are mobile relative to the head which carries the welding bars (110) and knife (115).

9. An apparatus as claimed in claim 7, comprising operating means (15, 16) for the head carrying the welding bars (110) and knife (115) acting, together with presser means (101), on the cutting and welding units (11) while said cutting and welding units (11) are being moved by the service conveyor (8).

10. An apparatus as claimed in claim 4, wherein the service conveyor (8) comprises spaced-apart guide and dragging means (10) for receiving and moving the welding and cutting units (11).

11. An apparatus as claimed in claim 4, wherein the recycling conveyor (12, 13, 14) comprises three sections, a raising section (13) for removing the welding and cutting units (11) from the service conveyor (8), a lowering section (12) for locating said units (11) on the service conveyor (8), and an interconnection section (14) for transferring said units (11) from the raising section (13) to the lowering section (12).

12. An apparatus as claimed in claim 11, wherein the raising section (13) and lowering (12) section comprise means (144, 144', 146, 146') for the removable coupling of the welding and cutting units (11).

13. An apparatus as claimed in claim 11, wherein the interconnection section (14) comprises, for the welding and cutting units (11), straight guides (162) provided at their ends with deviators (164, 180) for correctly guiding said units.

14. An apparatus as claimed in claim 13, wherein the interconnection section (14) comprises thrust members (170) mobile along a continuous path comprising a straight portion (177) along which they act on the welding and cutting units (11), to push them.

15. An apparatus as claimed in claim 14, wherein the straight portion (177) is inclined to the horizontal in the upward direction from the raising section (13) to the lowering section (12), and is also inclined to the straight guide (162), the straight guide (162) being also inclined to the horizontal.

16. An apparatus as claimed in claim 11, wherein the raising (13) and lowering (12) sections also comprise support means (143, 143') for the welding and cutting units (11).

17. An apparatus as claimed in claim 11, wherein the lowering section (12) is arranged such that a descending unit (11) interferes with the covering film (B) so as to drag it downwards.

18. An apparatus as claimed in claim 10, wherein upstream of the service conveyor (8) there is provided a reclinable chute (34) along which the batches of items (4) are individually moved by foldable reciprocating pushers (6) which can be folded back.

19. An apparatus as claimed in claim 18, comprising a feed conveyor 5, and wherein the foldable pushers (6) are activated when retractable stops (49, 49') associated with said feed conveyor (5) for the batches of items (4) become inactive.

20. An apparatus as claimed in claim 19, wherein the feed conveyor (5) is projectingly interposed within a structure (20) which carries at least two pairs of reels (2, 3) of the films (A, B) and is mobile transversely to the feed conveyor (5) to enable the reels of one pair to be switched-over with those of the other pair.

21. An apparatus as claimed in claim 20, wherein the structure (20) comprises pre-stretching devices (24, 25) for the films (A, B).

22. An apparatus as claimed in claim 20, wherein the structure (20) comprises take-up devices (27, 28, 29) for the films (A, B).

23. An apparatus as claimed in claim 20, wherein the structure (20) comprises the reclinable chute (34) and, in relation to the reels (2), a retractable carriage (31) for guiding the relative covering film (B).

24. An apparatus as claimed in claim 10, wherein the service conveyor (8) comprises means (503) which are able to move in a guided manner in at least two mutually perpendicular directions so as to grip and retain the items of each batch (4) during their packaging and to lower each batch from a surface along which said batch of items (4) is fed to said service conveyor.

25. An apparatus as claimed in claim 24, wherein the means for gripping and retaining the items (4) during their packaging are retention members (503) arranged symmetrically on opposing sides (501, 502) of the service conveyor (8) and mobile along fixed guides (517, 518), each member (503) comprising a hollow tubular element (504) with which there is associated a substantially flat element (505) arranged to position itself to the side of each batch of items (4), there being associated with said hollow element (504) an element (511) carrying a plurality of fingers (514) which project perpendicularly to said element (511), to be positioned, when the members (503) grip each batch of items (4), between the actual items themselves so as to form a containing cage for the items (4).

26. An apparatus as claimed in claim 25, wherein each retention member (503) comprises a slide (518) slidable along fixed guides (519, 520) associated with the service conveyor (8), the tubular element (504) being rigid with said slide (518).

27. An apparatus as claimed in claim 25, wherein the flat element (505) and the element (511) carrying the projecting fingers (514) are mobile relative to the hollow tubular element (504).

28. An apparatus as claimed in claim 25 further comprising members (516, 521) slidable along fixed guides (517, 522) and rigid with each element (511) carrying the projecting fingers (514), and with each slide (518).

29. An apparatus as claimed in claim 25, wherein the projecting fingers (514) are associated with each other in pairs via connection elements (530, 531) hinged together (at 532) and to said fingers (at 533), said connection elements being hinged together (at 532) at a fixed point on support plates (534, 545), relative to which the projecting fingers (514) can move axially, said plates (534, 545) being carried by each element (511) of the retention member.

30. An apparatus as claimed in claim 29, wherein the plates (534, 545) are located in a support member (513) for the fingers (514) and are parallel to other plates (546) with which the projecting fingers (514) are rigid, and with which the pins (53) on which the connection elements (530, 531) are hinged are rigid.

31. An apparatus as claimed in claim 29, wherein there is rigid with a support member (513) at least one elastic means (590) arranged to return the projecting fingers (514) into a rest position after their withdrawal from between the items and after the retention members (503) have moved apart.

* * * * *